US009999302B2

(12) United States Patent
Knepper

(10) Patent No.: US 9,999,302 B2
(45) Date of Patent: Jun. 19, 2018

(54) FURNITURE DRAWER LOCKING MECHANISM AND METHOD FOR IMPLEMENTING THE SAME

(71) Applicant: Ronald L Knepper, Bala Cynwyd, PA (US)

(72) Inventor: Ronald L Knepper, Bala Cynwyd, PA (US)

( * ) Notice: Subject to any disclaimer, the term of this patent is extended or adjusted under 35 U.S.C. 154(b) by 0 days. days.

(21) Appl. No.: 15/286,853

(22) Filed: Oct. 6, 2016

(65) Prior Publication Data

US 2018/0098629 A1 Apr. 12, 2018

(51) Int. Cl.

*A47B 95/00* (2006.01)
*A47B 67/04* (2006.01)
*A47B 47/00* (2006.01)

(52) U.S. Cl.

CPC ..... *A47B 95/008* (2013.01); *A47B 47/0075* (2013.01); *A47B 67/04* (2013.01)

(58) Field of Classification Search

CPC ... A47B 95/008; A47B 95/002; A47B 97/001; A47B 47/0075; A47B 2220/0052
See application file for complete search history.

(56) References Cited

U.S. PATENT DOCUMENTS 3,950,049 A * 4/1976 Drass ..... A47B 95/008 312/198
4,457,436 A * 7/1984 Kelley ..... A47B 95/008 211/88.01
5,718,493 A * 2/1998 Nikolai ..... A47B 95/008 312/245
9,526,336 B2 * 12/2016 Wells ..... A47B 95/008
2005/0072894 A1 * 4/2005 Grant ..... A47G 1/1606 248/475.1
2006/0243688 A1 * 11/2006 Gilcrest ..... A47B 95/008 211/87.01
2009/0152217 A1 * 6/2009 Gmerek ..... A47F 5/0838 211/27
2011/0025180 A1 * 2/2011 Ilich ..... A47B 95/008 312/237
2013/0180202 A1 * 7/2013 Woods ..... A47B 5/00 52/710
2017/0135483 A1 * 5/2017 Cattaneo ..... F16B 2/065

* cited by examiner

*Primary Examiner* — Daniel J Rohrhoff
(74) *Attorney, Agent, or Firm* — Bradley N. Ruben

(57) ABSTRACT

Furniture, such as bookcases and dressers, are child-proofed against tipping forward by being mounted to a wall by a combination of a rail attached to the furniture, the rail having an angled undercut, and a cleat. The rail and cleat have corresponding angled cuts so that, when the furniture is properly installed, the rail rests on the cleat and the furniture is prevented from tipping or falling forward. The cleat should be attached to a structural member, such as a stud behind drywall. An additional safety device for furniture having drawers is a retainer that, in an engaged position, holds existing drawers in place, and prevents the full insertion of drawers, unless the furniture is installed on a firmly attached cleat. The cleat disengages the retainer during proper installation of the furniture on the cleat, whereby drawers can be fully inserted and removed as desired by the user. Thus, a child climbing on open drawers in a dresser, or on shelving in a storage unit, will not be subjected to injury or death by the furniture tipping forward on to the child.

20 Claims, 9 Drawing Sheets

119
317
111
515
509
507
201
305
501
505
503
511

305
523
521
525

201
507
111
521
525
523
305
527

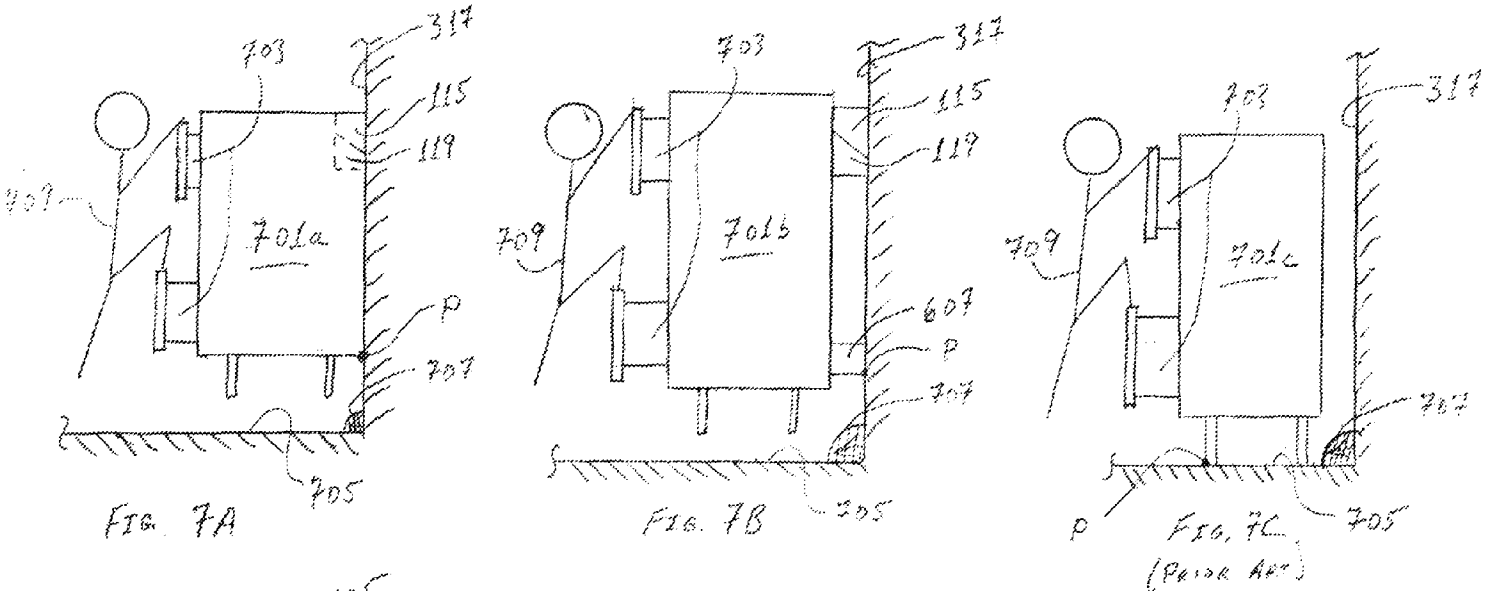
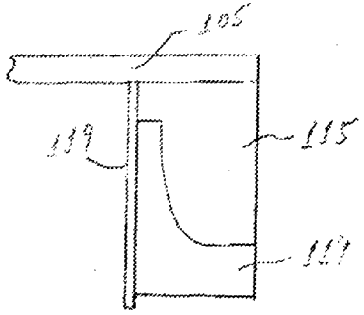
FIG. 3E
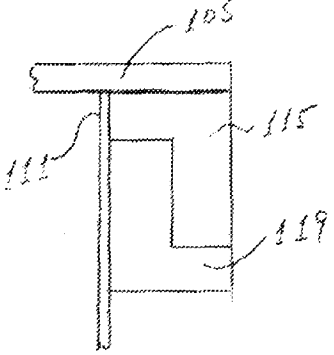
FIG. 3D

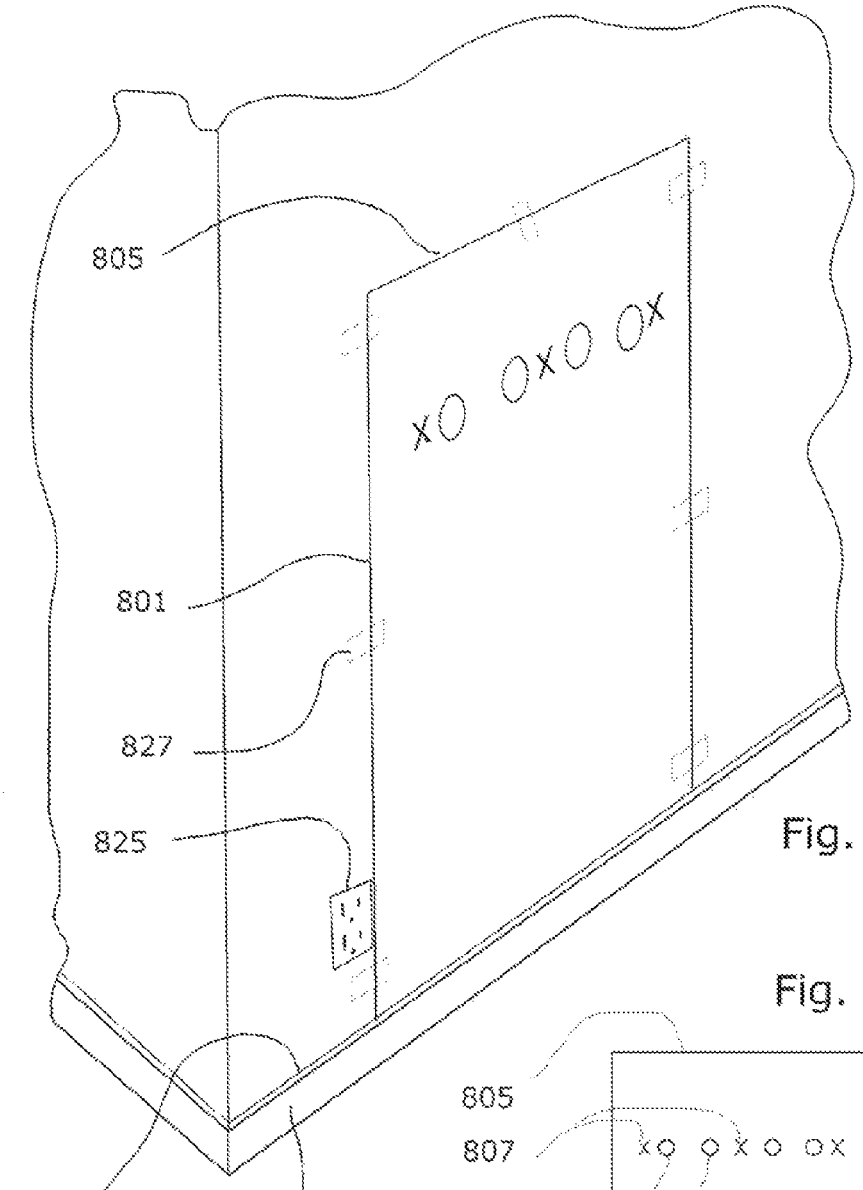
Fig. 8B
Fig. 8A
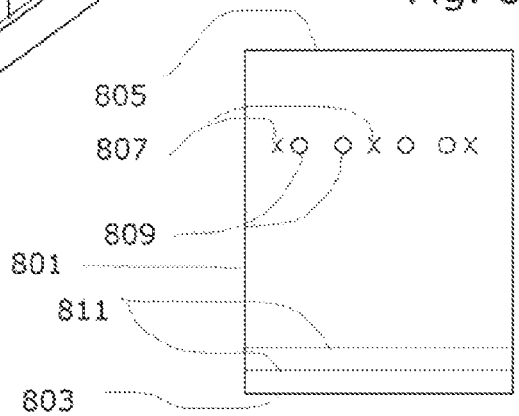

FURNITURE DRAWER LOCKING MECHANISM AND METHOD FOR IMPLEMENTING THE SAME

FIELD OF THE INVENTION

This invention relates to mechanisms for securing drawers in furniture and to methods for installing furniture having use of drawers therein disabled unless the furniture is properly installed.

BACKGROUND OF THE INVENTION

Dressers, bookcases, and similar types of furniture often include drawers. These types of furniture are often free-standing, and very often are relatively narrow front-to-back, which makes them subject to tipping over (back-to-front). When fully loaded, this tendency to tip over can be dangerous. This is also true for relatively shorter pieces of furniture that may have a height less then an adult but taller than a child. There have been instances of children climbing upon open or partially-opened drawers in dressers, or climbing onto shelving, where the weight of the child has caused the furniture to tip over and seriously injure or kill the child, or where the furniture tips and an item stored on the furniture slides or falls forward off the furniture and onto the child.

The industry solution to this problem, if one is provided to the consumer at all, is to include a tether and a screw with the furniture being purchased. The consumer is expected to connect the furniture to the rearwardly-adjacent wall by a single screw provided by the manufacturer. However, consumers rarely locate the furniture such that the tether can be secured to a stud in the wall, even assuming the wall is made of drywall, and instead locate the furniture where it is convenient and desirable. Accordingly, the holding force, if the device is attached at all by the consumer, is insufficient to prevent the furniture from tipping over. For other types of walls, such as brick or stone, the screw provided by the manufacturer is not suited for attachment to such a wall.

SUMMARY OF THE INVENTION

In light of the foregoing, one object of this invention is to provide a method for installing the furniture to prevent the furniture from tipping. By preventing tipping the furniture cannot fall over forward, nor can an item stored thereon thereby have the impetus to slide or fall forward and cause injury or worse.

Another object of this invention is to disable use of any drawers present in an article of furniture, and to provide enable use of the drawers only if the furniture is properly installed.

Still yet a further object of this invention is to incorporate any of the foregoing objects into unassembled, knock-down furniture.

A further object of this invention is to provide for a method for installing such furniture in a manner to prevent it from tipping.

Still yet another object of this invention is to provide a kit including assemblable furniture including a cleat for securing such furniture, when assembled, to a wall.

Still yet another object of this invention is to provide a child-proofing kit for pre-existing furniture to prevent tip-overs.

BRIEF DESCRIPTION OF THE DRAWINGS

FIGS. 3D and 3E depict partial side elevation views of alternative embodiments of the junction between the rail and cleat.

FIG. 6B is an exploded rear perspective view with the furniture, and a rail and cleat provided as part of a kit for attachment to existing furniture.

FIGS. 7A-7B depict side elevations of embodiments of the present invention, and FIG. 7C depicts a similar side elevation of the prior art.

FIG. 8A depicts a template used to aid in positioning the cleat on a wall, and FIG. 8B shows the template in FIG. 8A taped to a wall.

DETAILED DESCRIPTION OF PARTICULAR EMBODIMENTS

Figures 1A, 1B:
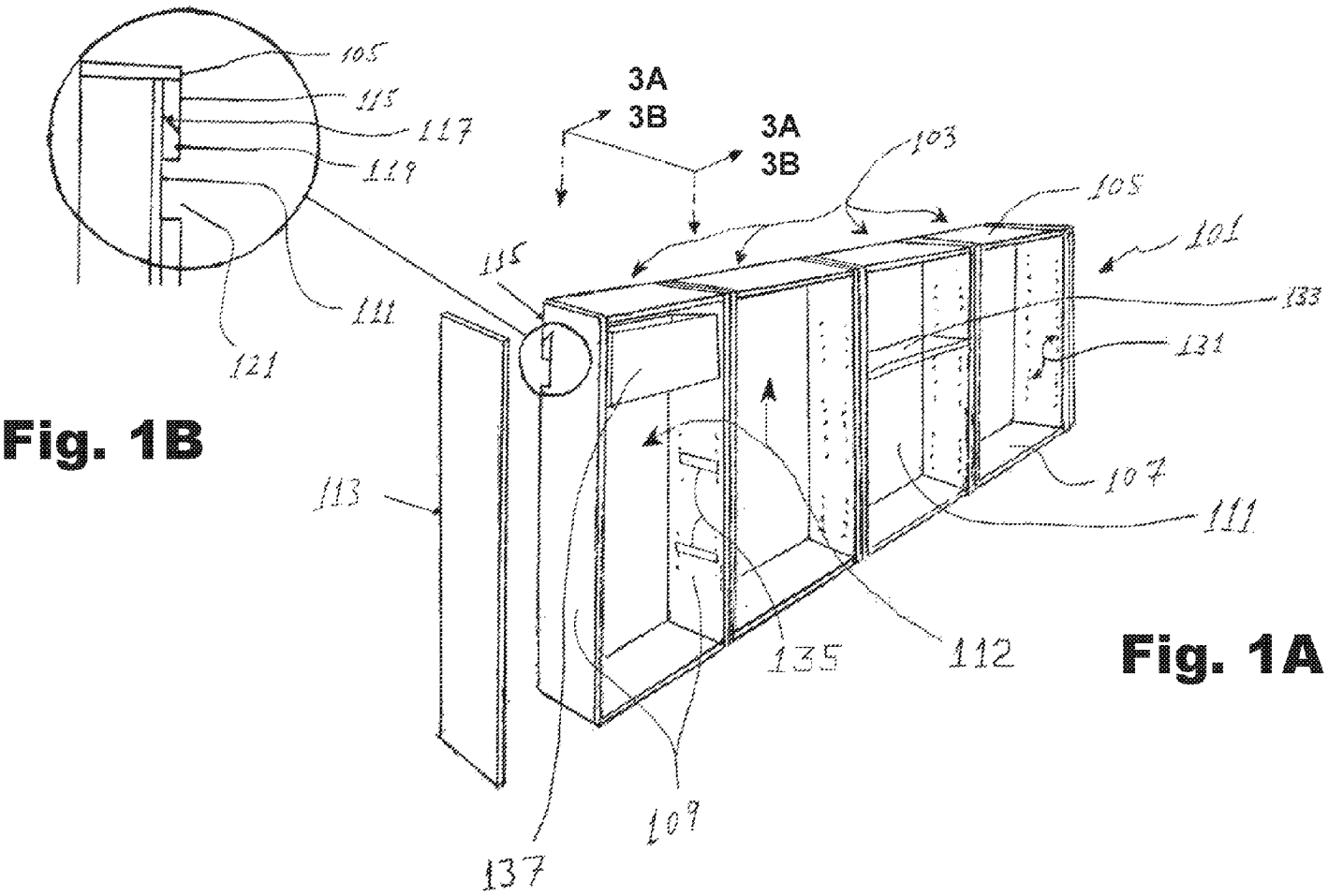
FIG. 1A is a front perspective view of an embodiment of this invention showing multiunit storage furniture having four units.
FIG. 1B is a close-up side elevation of portion 1B in FIG. 1A.

One embodiment of this invention is shelving, such as a bookcase. An article of multiunit shelving 101 is shown in FIG. 1A, in which each unit 103 comprises a top panel 105, a bottom panel 107, depending side panels 109 joined at opposite ends thereof to the top and bottom panel of a particular unit, and a back panel 111 joined so as to form a frame (often termed a "case body" in the furniture industry). The frame defines an interior space 112, within which, when the article is fully assembled, can be drawers and/or shelving as is conventional for storage units. The multiunit storage furniture is shown in FIG. 1 as modular, wherein each unit has side panels so that there are two side panels between the interior space 112 of each unit. In another embodiment, the multiunit article can be made with only a single side panel separating the interior space of each unit. To each endmost side of the multiunit article is an side-capping panel 113. The face of the side panels facing the interior space can be provided with a series of holes 131 into which shelving hardware can be installed to support a shelf 133 within the interior space of the furniture.

Behind the back panel at the top of each unit, as shown in FIG. 1B, a close-up of section 1B in FIG. 1A, is a rail 115 connected preferably to the top panel and the two side panels of the unit, although the rail can be connected only to the top panel or only to the side panels. The rail has an angled undercut 117 with the shorter vertical length of the rail facing the back panel and the longer vertical length at the rearmost portion of the unit, opposite the front face 123 of the side panel. In other words, as shown, the horizontally-disposed rail has a first vertical extent greater rearward than a second vertical extent more forward to create a space below the rail separated from the most rearward portion of the rail by the thickness of the rail.

The combination of the undercut in the rail and the back panel allows the rail to cooperate with a cleat 119 having a corresponding angled cut that engages the rail at the undercut. That is, the cleat is disposed horizontally on a wall and has a first vertical extent immediately adjacent the wall that is less than a second vertical extent disposed distally (that is, away) from the wall. Thus, the angle of the cuts on rail and the cleat are the same (within manufacturing tolerances) so that the rail and cleat meet flush. As shown in FIG. 1A, each of the side panels has a cutout portion providing a space 121 to accommodate the cleat. As described in more detail following, the cleat is permanently attached to a wall, most preferably with anchors to studs behind drywall (or with appropriate masonry anchors if the wall is brick or stone), and the unit is hung on the cleat. The cutout portion allows the unit to be raised and placed against a wall having the cleat previously installed, and then allowed to move vertically downward so that the cleat engages the rail, thereby securing the furniture to the wall. In the embodiment shown, the cleat thus engages both the rail and the side walls; that is, the furniture hangs on the cleat by a combination of the rail and the side panels. This is a preferred embodiment where the back panel is less structurally robust than the side panels, as is often the situation in KD furniture, where the back panel is more cosmetic than structural. Although less preferred in instances where the back panel is more cosmetic than structural, the side panels are provided without a cutout portion and the cleat engages only the rail, thereby eliminating a need for a side-capping panel to cover the cutout portions of the side panels in order to provide a cosmetically acceptable side elevation view of the furniture.

The side, top, bottom, and back panels are connected to each other by furniture hardware well-known in the art. If provided to the purchaser or consumer as KD furniture (that is, "knock-down" furniture, also variously known as RTA or "ready-to-assemble" or "flat-pack" furniture).

Figures 2A, 2B:
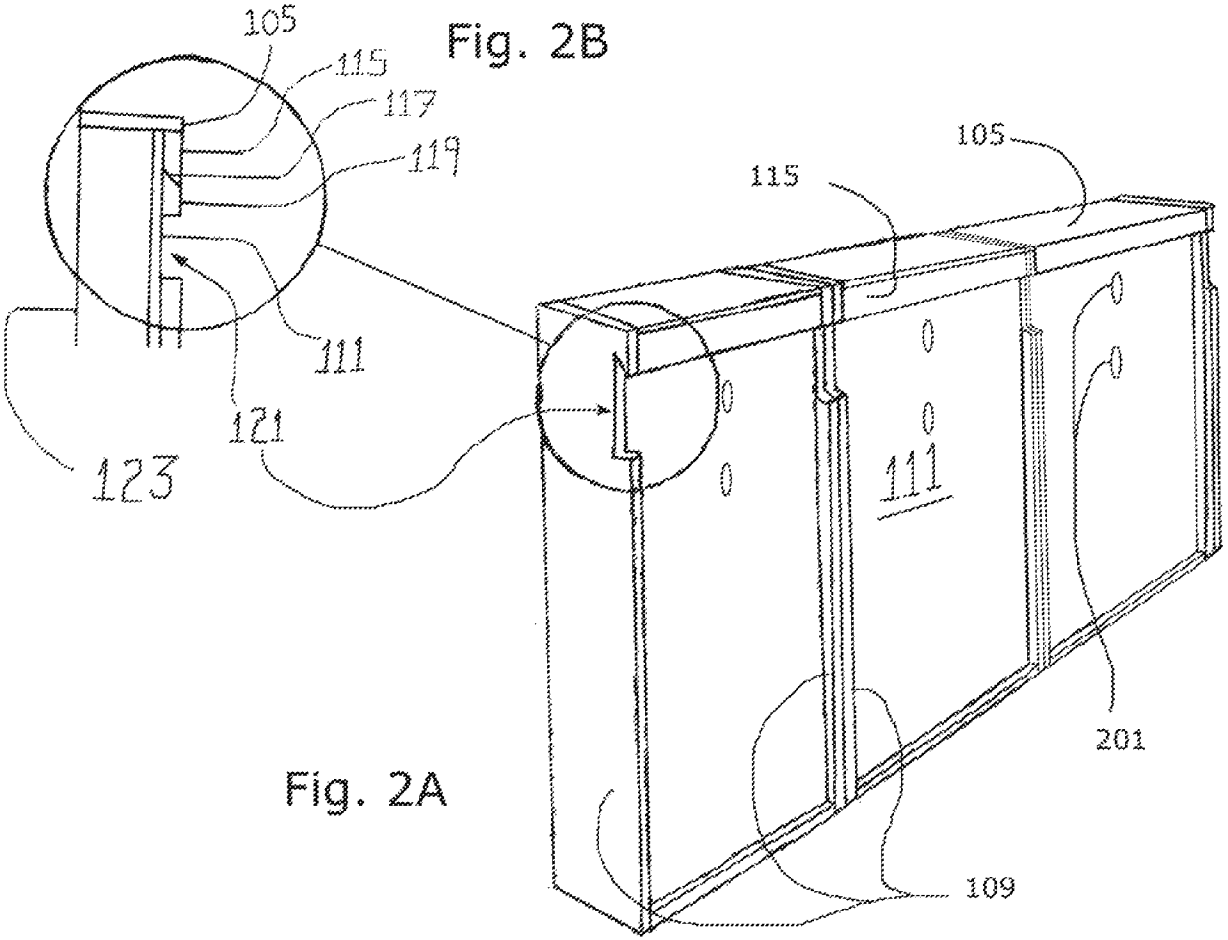
FIG. 2A is a rear perspective view of an embodiment of this invention showing multiunit storage furniture having three units.
FIG. 2B is a close-up side elevation of portion 2B in FIG. 2A.

FIG. 2A depicts a rear perspective view of multiunit storage furniture having three portions, each of which has a top panel, two side panels, and a back panel, and a top rail connected between side panels to both the side panels and the top panel. As shown, where all of the side panels are the same and have a cutout portion 121, the cutout portion provides a contiguous space spanning all three of the units, thereby allowing for a single cleat to support the entire multiunit article of furniture. There is a back panel slot 201 through which a pin extends, as described below, for furniture designed to accommodate drawer(s) 137. As mentioned above, especially if the back panel has sufficient integrity, and regardless of whether there is one or two side panels separating the respective interior spaces of adjacent storage units, if the side panel is not provided with a cutout, then a separate cleat is required for supporting each unit. Even if the side panels are identical and have a cutout, it is at the manufacturer's discretion whether to sell a separate cleat for each storage unit, whereby all of the cleats will be essentially the same and facilitating manufacture of identical cleats, or whether cleats of different lengths will be sold to accommodate different numbers of adjacent storage units. Alternatively, cleats of, for example, two sizes can be sold, such a cleat having a length to accommodate a single unit and another having a length to accommodate two units, so that any number of units can be assembled together with a desired number of portions and mounted to a wall using a combination of the two cleats.

Figure 3A:
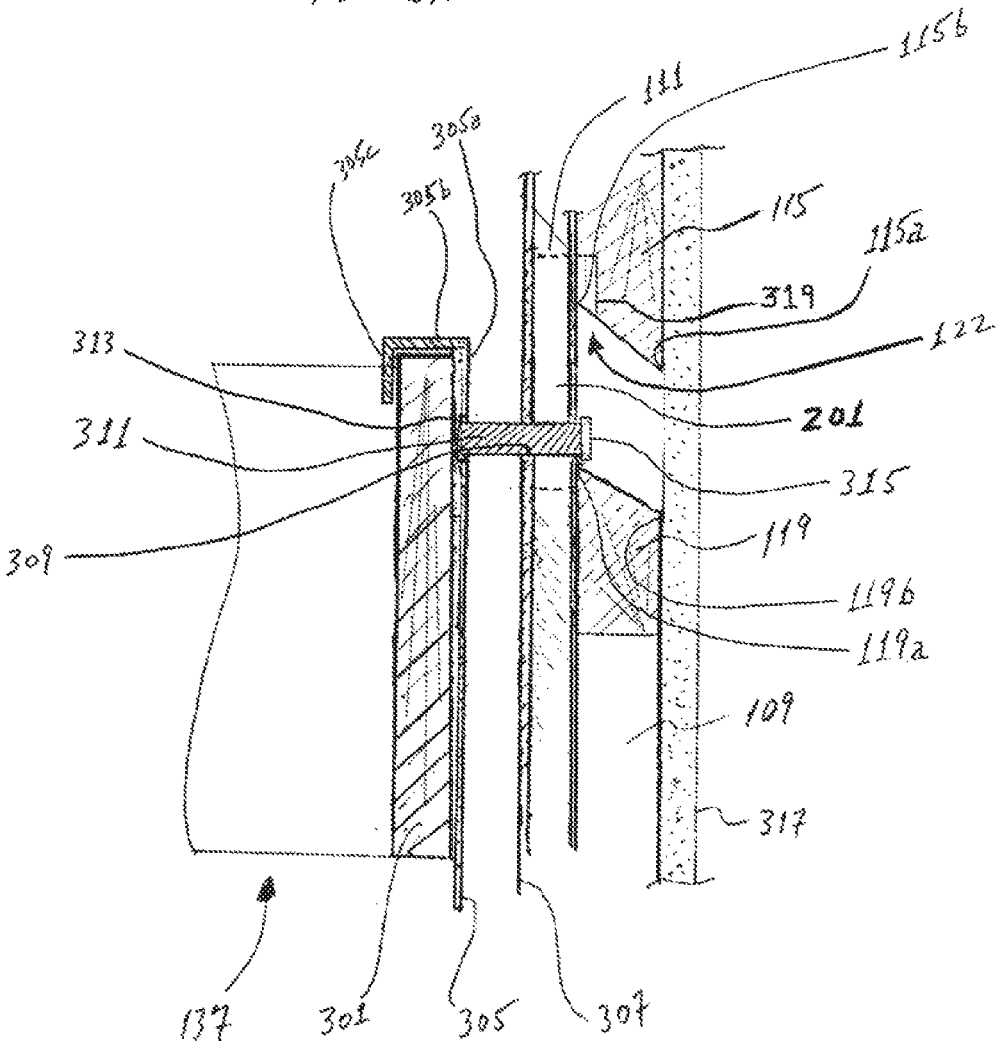
FIGS. 3A and 3B are partial cross-sections through line $\mathbf{3}^{A}_{B}$-$\mathbf{3}^{A}_{B}$, respectively, as shown in FIG. 1.
Figure 3B:
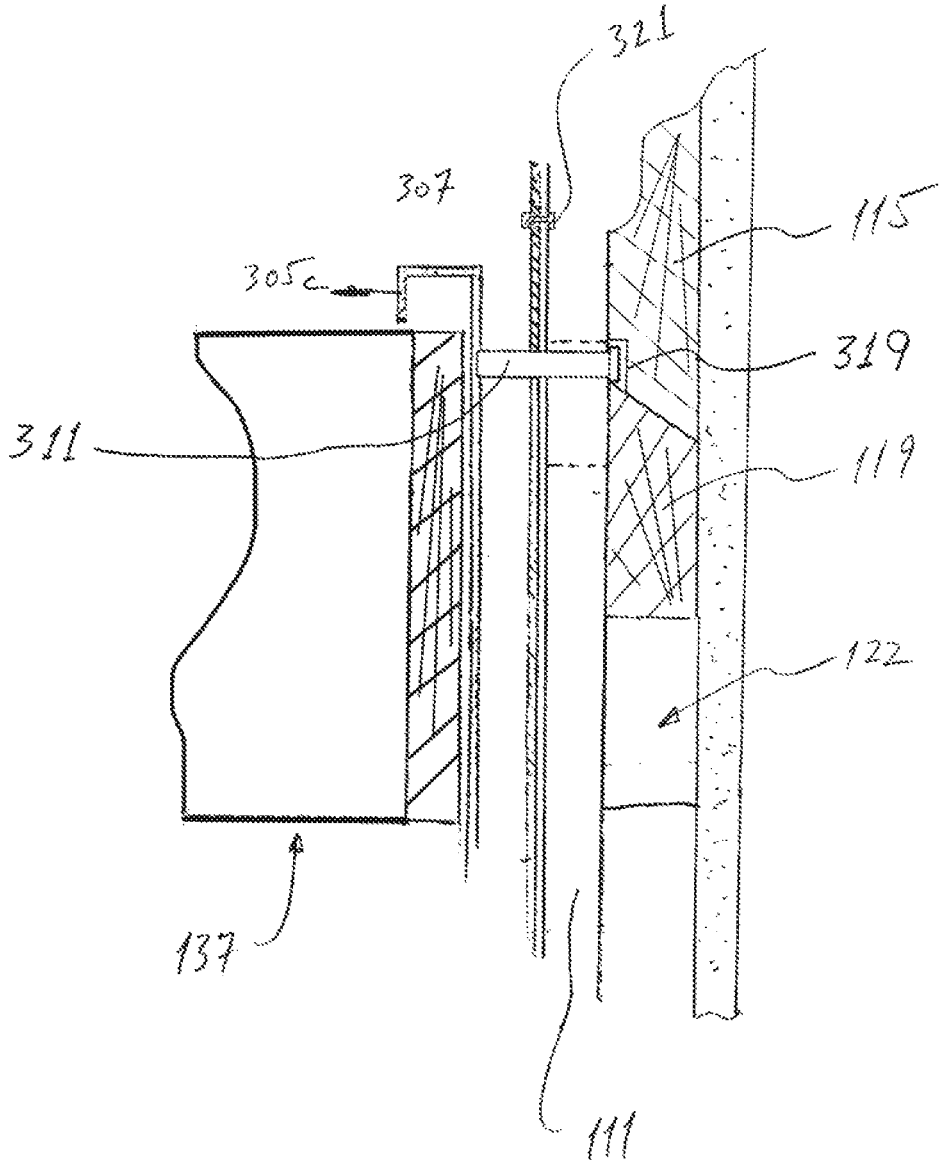

FIGS. 3A and 3B each depicts a cross-section taken along line through line $3^{A}_{B}$-$3^{A}_{B}$, shown in FIG. 1 of storage furniture having a drawer. FIG. 3A shows the furniture flush against the wall in the process of being mounted thereto, and FIG. 3B shows the furniture mounted to the wall.

More particularly, FIG. 3A depicts a drawer 137 having a drawer back 301 and attached thereto a retainer 305. The retainer has a depending leg 305*a* to which is attached essentially horizontal thereto on the front face thereof an arm 305*b* extending in the direction towards the front of the furniture and attached to the arm, preferably at the end thereof, is a depending finger 305*c*, whereby the combination of the arm and finger essentially provides a hook or clamp for engaging the top portion of the drawer, preferably at the drawer back. The retainer is preferably made of metal, or plastic that preferably has an added weight, so that it tends downward due to gravity such that the hook portion engages the drawer.

Attached to the retainer leg and extending from a back face thereof towards the rear of the furniture is a pin 311 connected to the retainer leg at a fitting 313 disposed in and/or attached to the retainer leg. Preferably, though not essential, is a guide 307 attached to the front portion of the back panel 111; the guide is preferred especially when the back panel, as mentioned previously, is relatively thin and more for cosmetic appearance than structural integrity and thus is subjected to warping or otherwise not being straight. That is, the back panel of KD furniture is often constructed of a material such as fiberboard or particle board or even paperboard where the design of the furniture allows the back panel to be mostly cosmetic; for example, when attached to the top, bottom, and side panels it maintains the rectilinear orientation of the frame rather than bearing significant weight of the frame parts or the articles stored. In contrast, the other panels (top, bottom, side) are often constructed from MDF (medium-density fiberboard), although thicker particle board can also be used as various materials are known in the industry for manufacturing furniture, including KD furniture. The rail and cleat are preferably made from a material selected from the group consisting of wood, hardboard, oriented strand board, because they are structural members. The guide includes guide slot 309 through which the pin passes, and the pin extends out of the aforementioned back panel slot 201 in the rear panel as shown in FIG. 2A. At the rearward end of the pin is an endcap 315 sized larger than the back panel slot 201 in the back panel to prevent the pin, and thus the retainer, from being removed from the configuration shown. Preferably, the pin is a threaded metal bar, as are the fitting and endcap, whereby all three can be screwed together, and a thread-locking composition (typically a thixotropic methyl-methacrylate adhesive, such as LOCTITE® brand, Henkel Corporation, Rocky Hill, Conn.) is used during assembly to lock the three together. Any of these components could, instead, be made of plastic and secured to the cooperating component with a suitable adhesive. The guide slot 309 has a vertical extent allowing the retainer with the pin secured through the guide slot to move vertically upward and downward.

As described above, the horizontally-disposed rail 115 has a first (rear face) vertical extent that defines a rearward bottom edge 115*a*, the first vertical extent greater than a second (front face) vertical extent more forward that defines a forward bottom edge 115*b* to create a space 122 below the rail, and separated from the most rearward portion of the rail by the thickness of the rail. Likewise, the cleat has a first (front face) vertical extent away from the wall 317 that defines a forward top edge 119*a* and a second (rear face) vertical extent adjacent the wall that defines a rearward top edge 119*b*, the first extent being greater than the second. (Of course, the terms "greater" and "lesser" are used herein with the assumption that they are measured from a planar horizontal top or bottom side, respectively, regarding the rail and cleat. The important aspect is that, when the furniture is mounted on the cleat, as shown below in FIG. 3B, motion of the furniture and the attached cleat away from the wall, as would occur if the furniture were tipping forward, will be resisted by the cleat.)

As shown in FIG. 3A, pre-assembled furniture with a drawer locked in place by the retainer and a cleat 119 already having been attached to the proper place on the wall 317 (drywall being shown) where the furniture is to be installed, is placed with the back essentially flush against the wall so that the rearward portion of the pin extending rearward through the back panel is disposed between the cleat and the rail 115. The furniture is then, under the control of the person(s) installing the furniture, allowed to slide down the wall, whereby the fixed cleat engages the pin, lifting the retainer to release the drawer. Downward movement of the rail continues until the undercut engages the corresponding portion of the cleat. The undercut in the rail includes a channel 319 sized to accommodate receipt of the rearward portion of the pin and attached endcap effective to allow the undercut of the rail to engage the angled portion of the cleat in an essentially flush engagement. The resulting configuration is shown in FIG. 3B, with the furniture firmly secured by the rail to the cleat, and the retainer disengaged from the drawer. The guide is attached to the back panel, such as by two or more rivets (such as 321 shown in FIG. 3B), rivets, or similar mechanical fasteners.

Figure 3C:
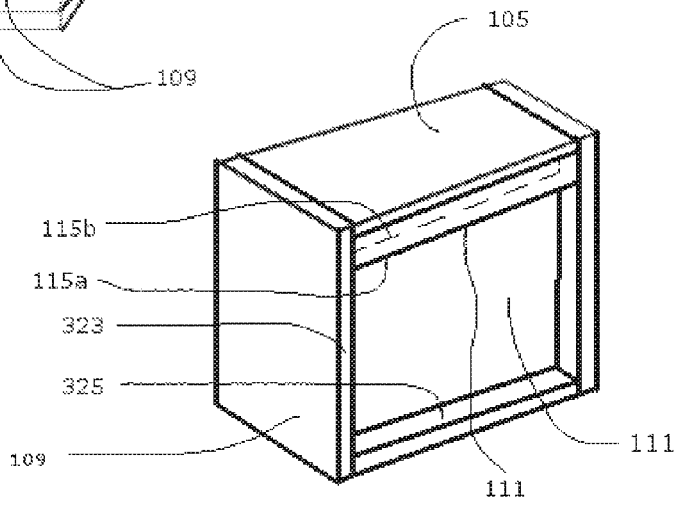
FIG. 3C is a rear perspective view of an embodiment with the back panel set forward from the back face of the furniture.

FIG. 3C is a rear perspective view of another embodiment in which the back panel 111 is set forward from the rear face 323 (that is, depicting the rearmost of the side, top, and/or bottom panels) of the furniture to provide a recess 325 between the back panel and the rear face, that is, a recess forward of the rear face. The rail 115 is mounted directly to the side panels 109, and preferably also the top panel 105. In the embodiment, the cutout portion 121 in the side panels is not needed.

The drawings depict the rail and cleat having, preferably, an angled junction of, preferably, about 450. Other configurations of the engagement of the cleat and rail are possible. As shown in FIGS. 3D and 3E, partial side elevations (without the cover 113), the rail can cleat can be configured as a half lap joint (FIG. 3D; that is, engaging "L"-shaped rail and cleat) or even a curved junction (FIG. 3E). Thus, the rail and cleat have solid geometries allowing the two to operably engage along an extended surface when the furniture is installed. As described, the preferred geometry is where each is an integral combination of a right triangular prism with a right rectangular solid integral with one of the non-hypotenuse sides of the prism, so that the cross section is a rectangle integral with one of the sides of a right triangle.

In all of the foregoing embodiments, disengaging the furniture from the wall requires that the furniture be raised. It is highly unlikely that a child would be able elevate the furniture to such an extent as to disengage it from the wall attachment, and thus the furniture is child-proofed against tip-over.

It is preferred, as described above, that the load of the furniture be carried by the sides. Likewise, it is preferred that the rail be well-attached to the sides. If the rail is attached to the inner surface of the sides (that is, the faces defining the interior space 112), then robust hardware is required. Such hardware includes, for example, a joist hanger. If the rail is attached in such a manner, the side panels should not be hung from the top panel because the entire load would be acting on the attachment between the top and side panels. As described, it is preferred that the rail be attached to the sides independent of the top and bottom panels, such as having a cut-out portion with the side panels resting on the rail.

Figure 4:
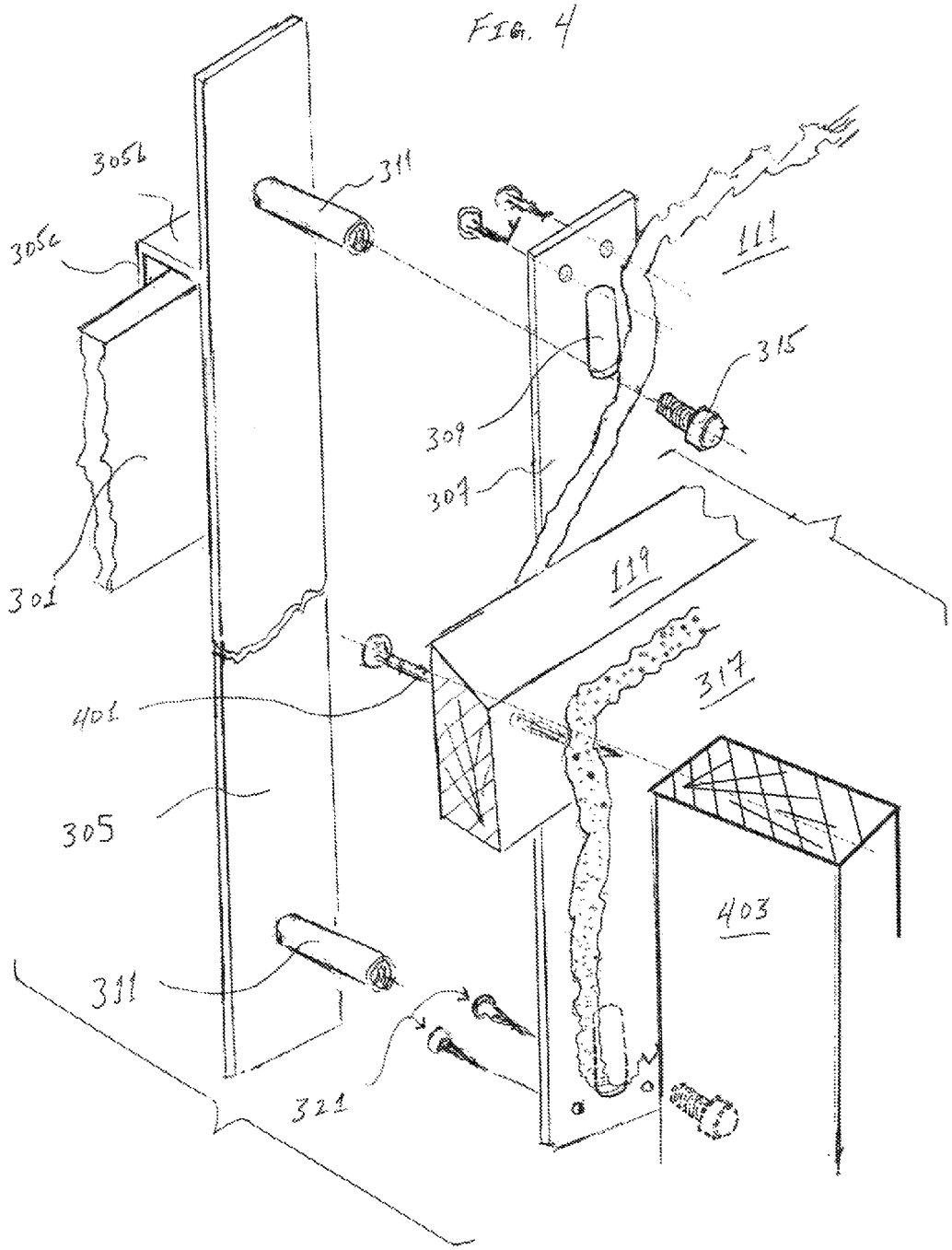
FIG. 4 is an exploded perspective with partial cross-section showing a drawer back, retainer, and guide, and a cleat attachment to a wall.

FIG. 4 is an exploded, partial cross-sectional depiction of the retainer 307 engaged with a drawer back 301 and pins 311 extending rearward from the retainer with guidelines showing that the pins traverse corresponding guide slots 309 in the guide. Likewise, the back panel will have corresponding back panel slots. Preferably, the retainer and guide, as well as the back panel, have, respectively, at least two corresponding pins and respective slots so that the retainer remains in an essentially vertical disposition and does not deviate to any significant extent in a direction parallel with the back panel that might hinder free vertical movement of the retainer. Likewise, it is preferably that the guide is secured to the front portion of the back panel at each of opposite vertically-disposed ends of the guide, such as by screws 321 shown in FIG. 4. The cleat 119 is attached securely to the wall by a permanent fastener, such as a screw 401 or nail, that penetrates the wall to reside within a stud 403 or other structural member sufficient to support the weight of the furniture, and preferably at a plurality of position along the horizontal extent of the cleat.

Figures 5A, 5B, 5C:
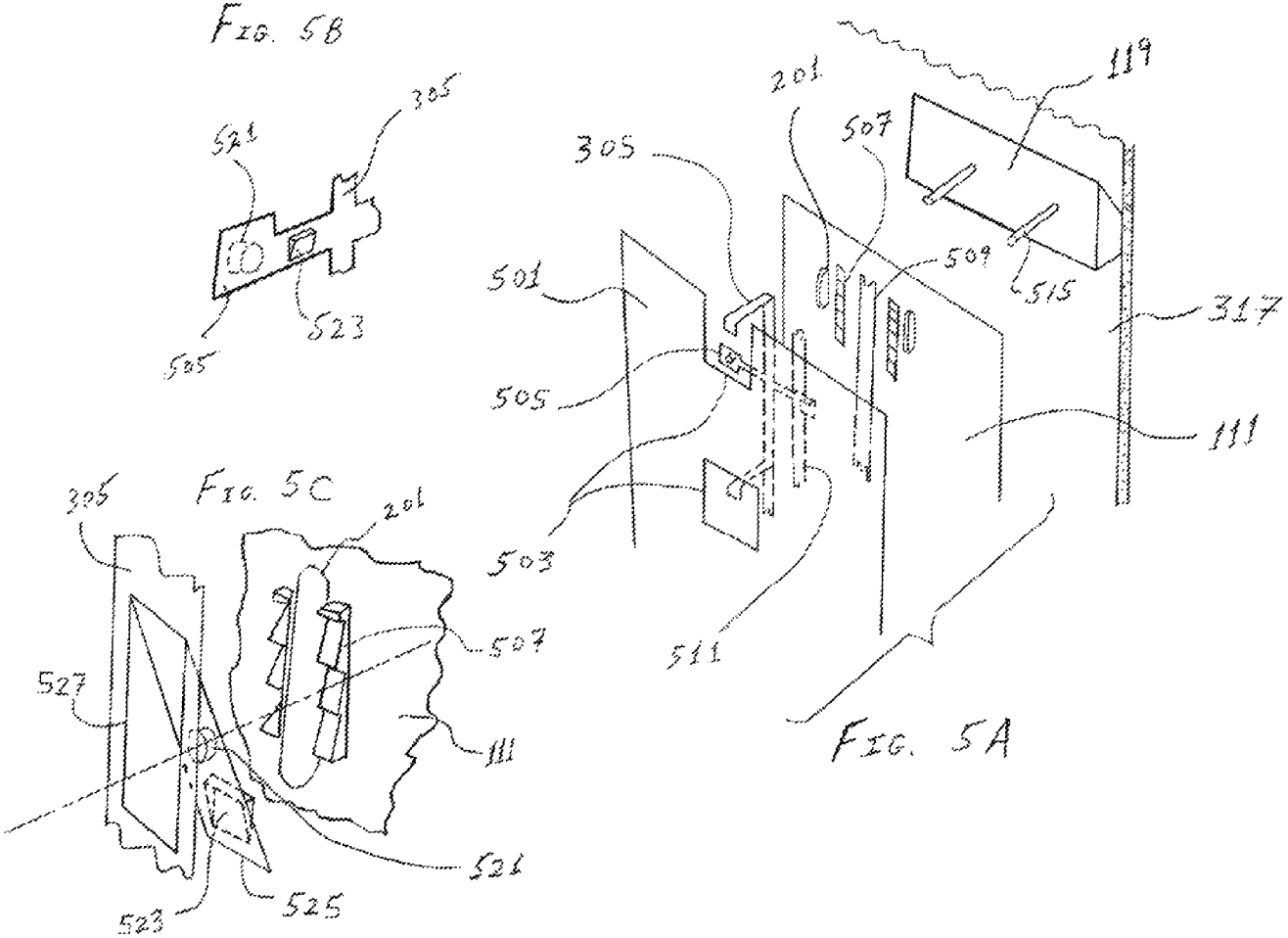
FIG. 5A is an exploded front perspective view of a further embodiment of the retainer.
FIG. 5B is a rear perspective view of a section of the retainer limb shown in FIG. 5A.
FIG. 5C is an exploded partial front perspective view of yet another embodiment of the retainer.

FIG. 5A, and exploded front perspective view of the rear portion of the furniture and the cleat, depicts another embodiment of a retainer according to this invention. A false back 501 is provided in the interior space of the furniture and includes a plurality of windows 503 through which retainer arms extend forward to lock corresponding drawers. It should be understood that other embodiments of the invention, such as those described with reference to FIGS. 3A and 3B, an also be provided with a false back forward of the retainer.

In another embodiment, also as shown in FIG. 5A, the aforementioned guide is substituted with a slide having male and female sections, one section 509 being attached to the front face of the back panel and the corresponding section 511 being attached to the back face of the retainer leg; preferably, the sections cooperate to function as a slide and to keep the two sections in such a functional relationship, thus obviating the necessity for additional attachment hardware. Thus, the retainer with the attached portion of the track is guided vertically in the track attached to the back panel. Each track can be attached by adhesive or mechanical means (screw, rivet) to the particular structure.

In a still further embodiment, also as shown in FIG. 5A, the cleat is provided with spikes 515 that, when the furniture is mounted, pass through the back panel slots 201 to engage and move the retainer to a position where the drawer(s) is released. One method for accomplishing this release is where the retainer leg further includes at least one pair of horizontally-extending limbs 505, which preferably function as leaf springs attached to the retainer leg; the limbs can be formed integrally with the leg or a separate piece attached thereto. As shown in FIG. 5B, a rear perspective view of a retainer limb, the distal portion includes a receptacle 521 for accepting a spike 515, shown in FIG. 5A, extending forward from the cleat. The limb also includes a wedge 523 that engages a ratched track 507 attached to the front surface of the back panel, as shown in FIG. 5A. The ratchet, when the wedge is engaged, prevents the retainer from being moved vertically upward to disengage the drawers unless the furniture is installed properly on the cleat. During installation, the spike on the cleat extends through the back panel slot, engages the receptacle on the retainer limb, and releases the ratchet, thereby allowing vertical movement of the retainer. As the furniture is moved down along the wall (or allowed to move by gravity) to seat the rail on the cleat, the relatively motion, analogous to the embodiment shown in FIGS. 3A and 3B, raises the retainer relative to the drawers to disengage the retainer from the drawers.

Another embodiment of the retainer with a ratchet is shown in FIG. 5C. A leaf spring 525 is attached to the back face of the retainer leg; if the retainer is made of metal then the leaf spring can be stamped out leaving a opening 527; otherwise, the leaf spring can be attached by such means as a rivet or adhesive. As with the embodiment shown in FIG. 5B, the leaf spring includes a receptacle 521 and a wedge 523. A ratchet track 507 is attached to the back panel laterally adjacent the back panel slot 201, or a pair thereof, as shown in FIG. 5C, on opposing lateral sides. The wedge has a horizontal extent sufficient to engage a ratchet track; thus, if the leaf spring is stamped out from the retainer leg, the leg similarly has a horizontal extent greater than the slot. The wedge can be formed a tab portion partially stamped out of a metal retainer leg and then bent to engage the ratchet track. In this embodiment, a single spike cantilevered from the cleat passes through the slot to engage the receptacle and release the wedge from the ratchet during installation of the furniture. This embodiment may include the guide 307, in which case the ratchet track is preferably attached to the guide rather than the back panel.

All embodiments can be manufactured as KD furniture. For example, in the embodiment shown in FIGS. 5A and 5B, the retainer, tracks, and ratchet tracks can be assembled as shown in the figure by the manufacturer, and the false back then attached to the back panel, to produce a relatively flat combined back assembly that can be flat-packed. So too, the embodiment shown in FIGS. 3A and 3B can be assembled prior to shipment as a flat-pack construction with the end-caps affixed in place so that retainer is permanently yet moveably connected to the back panel.

Manufacturing the embodiment shown in FIG. 3A as already assembled, or the embodiment shown in FIG. 5A with the false back already attached to the back panel when shipped, the consumer may still try to defeat the safety mechanisms described herein. Thus, it is preferred, for example, that the guide be attached to the back panel with rivets. Similarly, it is preferred that a warning label be attached with permanent adhesive to the front face of the locking leg, and also to the back face of the back panel, to the effect that "The cleat attachment to the wall and this mechanical drawer retention device are intended to assure proper installation of this furniture to prevent tip over and injury. Any attempt to remove this device, tamper with it, by-pass it, or defeat or disable it in any way, or to avoid mounting this furniture on a cleat firmly attached to a load-bearing wall structure, is done solely at the consumer's assumption of the risk that the furniture may tip over and cause injury or death." While the retainer ("mechanical drawer retention device" in the above warning) is intended to prevent drawers from being fully inserted when the furniture is sold as KD furniture, as well as to prevent drawers from being opened if the furniture is mounted with the drawers in place or sold pre-assembled, there appears to be no limit to which a consumer might resort to defeat a safety device.

Figure 6A:
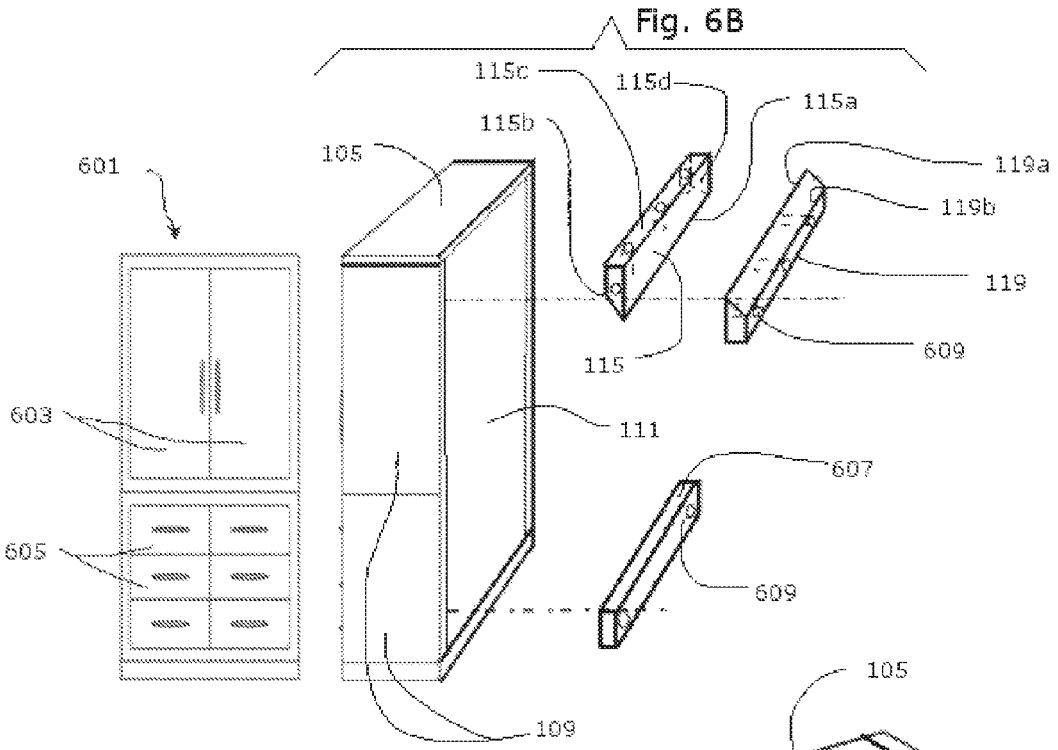
FIG. 6A is a front elevation of an article of furniture.

FIG. 6A is a front elevation of a piece of furniture 601 (an armoire, in particular) having shelving behind a cabinet doors 603 and drawers 605. In the case, for example, where a consumer has an existing piece of furniture without the benefits of the present invention, and desires to acquire such benefits (for example, the consumer and their significant other decide to have a child), the present invention provides a kit for retrofitting such an existing piece of furniture. The kit includes as separate pieces a rail 115, a cleat 119, and a spacer or beam 607, hardware for the attachment of each, and printed instructions for the attachment of the rail and cleat. The spacer functions like a shim, mostly to resist the transverse load of the furniture towards the wall, and to keep the furniture at a aligned with the wall so that the back is parallel with the wall. The spacer is preferably made of a relatively less expensive material such as fiberboard or even paperboard (for example, double-face corrugated-honeycomb composite paperboard). FIG. 6B depicts a rear perspective exploded view of the furniture depicted in FIG. 6A showing the locations for horizontal attachment of the rail to the top back of the furniture, the cleat to an adjacent wall, and the spacer to the bottom back of the furniture. Hardware for attachment of the rail preferably includes one or a plurality of brackets for attachment of the rail to the side and/or top panels of the furniture, along with furniture hardware or general hardware (such as screws), and the attachment of the rail and the spacer can be facilitated by having pre-drilled recess holes 609 in the top 115*c* and/or side 115*d* surfaces of the rail and through holes in the spacer between the front and back surfaces. Alternatively, if the spacer is manufactured of paperboard, the side for attachment to the furniture can be coated with an adhesive and protected with a release sheet so that the end user can remove the release sheet and adhere the spacer to the back of the furniture near the bottom. Similarly, the cleat can include pre-drilled through holes 609 from the front surface to the rear surface, preferably spaced at 16 inch centers corresponding to the modern convention of interior wall stud spacing. Through holes can also be provided at 8 inch spacings in case the furniture is to be situated offset from the studs, thus allowing the consumer some leeway in positioning the furniture in the room. The holes at the front surface of the cleat (that is, those to be facing the furniture) are preferably recessed. Suitable hardware for attaching the cleat include drywall anchors, toggle bolts, hollow wall anchors, and screws. While it is preferred that the cleat be attached directly to a stud, it may be easier for a consumer to install the cleat onto drywall using an anchor (or the consumer may feel more confident in undertaking such a project). The printed instructions preferably include written instructions to attach the rail to the furniture using the included hardware, to locate studs behind the wall (if installing onto studs), measure from the floor up to the longer rear edge 115*a* of the rail and record that measurement, use that measurement to create a horizontal line on the wall where the shorter rear edge 119*b* is to be located, and attaching the cleat to the wall; after the rail and cleat are attached to the furniture and the wall, respectively, the furniture (preferably emptied, including removal of drawers and shelves if possible) is lifted slightly and hung with the rail engaging the cleat. The instructions preferably also include pictorial representations of the various steps. The printed material and instructions are further described below with reference to FIGS. 8A and 8B.

FIG. 7A depicts an idealized elevation of a piece of furniture 701*a* made according to this invention and hanging from a wall 317 by means of the rail 115 engaging the cleat 119. The furniture shown is, for example, a dresser having drawers 703. The furniture is preferably mounted with the feet elevated from the floor 705 (the elevation shown being exaggerated and not necessarily to scale) to assure that the furniture is, in fact, properly mounted. The proper mounting can also be verified by the drawers able to be fully inserted and/or opened (depending on whether the furniture is sold KD or fully assembled). A baseboard (molding) 707 is shown at the junction of the wall and floor. A child 709 climbing on open drawers, if the furniture is installed properly, will not be injured by the furniture tipping over. FIG. 7B depicts an article of furniture 701*b* retrofitted using the aforedescribed kit having a rail, cleat, and spacer. As shown in FIGS. 7A and 7B, the depth (front to back) of the rail and cleat (including in combination) can be approximately the same depth as the molding extends along the floor from the wall (typically about ¾ of an inch in the U.S.). FIG. 7C depicts a prior art piece of furniture 701*c* not having the advantages of the present invention, in which it can be seen that the climbing child creates a moment force around point P. In contrast, while the child is further away from the point P of rotation at the point of contact between the spacer and the wall, an opposing force is generated at the attachment of the cleat to the wall. Thus, it is also preferably to mount the rail and cleat at the top of the furniture to maximize the lever arm from the force at point P.

The printed material included with the KD kit for assembly by a consumer preferably includes a paper template, an exemplary one being shown in FIG. 8A. Preferably, such a kit also includes prosaic instructions for using the template to install the furniture; the prosaic instructions can be accompanied by (or, instead can be) pictorial instructions. Most preferably, when a flat pack (KD) kit for assembly by a consumer includes a drawer retention system (such as set forth above), the instructions set forth that the case body (that is, the frame) must be assembled and installed (mounted) on the cleat before the drawers are inserted, otherwise the retention system 1*s* will prevent the drawers from seating properly. More particularly with reference to FIG. 8A, the template 801 is preferably made of paper, and is generally of the same size as the frame (top to bottom and side to side) such that it represents a "wallprint" representing the wall space taken up by the furniture unit (just as an object's footprint defines the floor space occupied thereby). The template has a bottom edge 803 and a top edge 805, and therebetween a horizontal row of a plurality of marks indicating points at which the cleat is attached to the wall. When attachment of the cleat is to studs, the preferred method, the points of attachment are indicated by the "X" marks 807, and if, instead, attachment is by drywall anchors (for example), the points of attachment are indicated by the "O" marks 809. The distance between each the "X" marks should be the same as is typical for stud spacing (that is, 16 inches in the United States). The span between the line of attachment marks ("X"s and "O"s) and the bottom edge will depend to the particular furniture model, as each model has a particular wallprint. Nevertheless, in all cases the line of attachment marks should be positioned such that when the furniture is mounted on the wall, it will be off the floor, as shown in FIGS. 7A and 7B.

The template also includes fold lines 811, where the furniture installer or customer folds the bottom to accommodate any existing baseboard and molding before taping the template to the wall, as shown in FIG. 8B. For example, a bottommost fold line would be for accommodating ¾-inch quarter round molding on a hardwood floor or for a carpeted floor, a next higher line would be for accommodating ¾-inch quarter round on top of carpeting, a next higher line would be for accommodating a 3-inch base board (821 in FIG. 8B), and a fourth higher line would be for accommodating 1-inch molding (823 in FIG. 8B) on top of a 3-inch baseboard (821), depending on the particular room in which the furniture is to be placed. The instructions can advise the consumer or installer to select the proper fold line, and to check by measuring from the floor (or carpeting, and the case may be) to where the wall starts from the floor, and to use the line closest to the bottom edge 803 if there is any doubt. The consumer then folds the template along that fold line.

Next, the consumer or installer must decide where to place the furniture in the room. It is preferred that the cleat be mounted to studs, and a first stud can be found adjacent to an electrical outlet 825. The consumer should verify that the stud is there with a stud finder, and more preferably with a small (e.g., 1.5") finishing nail gently hammered into the wall multiple times slightly offset horizontally to verify the width of each stud found. The first stud could adjacent an electrical outlet, and other studs should located at a standard distance horizontally therefrom measured center (of the stud) to center, but the extent of each stud should be verified. Otherwise, the cleat should be mounted using drywall anchors or other anchors suitable for the type of wall. After it is decided where the furniture is to be located, the template is taped to the wall with the fold touching the top of molding or baseboard, as the case may be. The template is preferably taped using a removable tape such as masking tape. Depending on the method chosen for attaching the cleat, the finishing nail is hammered through the "X"s (or "O"s) to verify that a stud is (or is not) present at each attachment mark. The template and tape is then removed, and the resulting marks on the wall (from the finishing nail) indicate where holes are to be drilled, or anchors set, as the case may be, for attachment of the cleat. After the cleat is attached to the wall, the case body (frame) can be mounted on the cleat, and then the drawers (if any) can be installed. The consumer should fold up the template and retain it (such as in the bottom of a drawer, or taped to the back of the furniture) in case it is desired to move the furniture to another location.

The foregoing description is meant to be illustrative and not limiting. Various changes, modifications, and additions may become apparent to the skilled artisan upon a perusal of this specification, and such are meant to be within the scope and spirit of the invention as defined by the claims.

What is claimed is:

1. An article of furniture, comprising:

a combination of a top panel, a bottom panel, side panels attached to and disposed between the top and bottom panels, and a back panel attached to at least one of said top, bottom, and side panels, to create a frame defining an interior storage space, said frame defining opposing front and rear faces, the back panel disposed adjacent the rear face, opposing side faces, and opposing top and bottom faces, the interior storage space accessible from the front face;

a horizontally-disposed rail attached to the frame closer to said rear face than to said front face, the rail having a bottom surface with first portion thereof closer to the front and top faces of the frame than a second portion thereof;

a retainer for securing a drawer within the article of furniture, said retainer having a back face including at least one pin attached to said back face and extending rearward from said retainer back face through a slot in said back panel, said slot having a vertical extent, an endcap attached to the rearward portion of the pin and unable to fit through the slot, whereby the pin is secured in the slot and the combination of the pin and retainer are free to move vertically.

2. The article of furniture defined by claim 1, wherein the rail is attached to the top panel.

3. The article of furniture defined by claim 1, wherein said rail is attached to said side panels.

4. The article of furniture defined by claim 1, wherein said retainer has a depending leg having a front face and said back face;

an arm disposed on the front face thereof extending towards the front face of the frame;

a finger disposed on the arm and depending therefrom towards the bottom face of the frame;

a plurality of pins attached to the back face of the retainer and extending towards the rear portion of the frame;

wherein the back panel further comprises a plurality of back panel slots corresponding to said pins, each of said back panel slots having a vertical extent, and each said pin extending through a corresponding back panel slot;

an endcap attached to the rearmost portion of each said pin, each endcap being unable to fit through said corresponding back panel slot;

whereby said retainer is attached to said back panel allowing vertical movement of the retainer along the vertical extent of said slot.

5. The article of furniture as defined by claim 4, further comprising a guide, said guide attached to a front portion of the back panel at opposing ends of a vertical extent of the guide, the guide comprising a number of guide slots corresponding to said number of pins, each said pin passing through a corresponding guide slot in the guide.

6. The article of furniture as defined by claim 4, further comprising a false back attached to said top panel and said side panels, or to said bottom panel and said side panels, said false back disposed between the front face and the retainer, said false back comprising a plurality of openings through which said arms extend.

7. The article of furniture as defined by claim 1, further comprising a cleat attached horizontally to a wall immediately adjacent and rearward of said furniture, said cleat having a top surface with first portion thereof closer to the front and top faces of the frame than a second portion thereof, the bottom surface of the rail resting upon the top surface of the cleat.

8. The article of furniture as defined by claim 1, wherein the rail comprises a recess in the bottom surface to receive the endcap and portion of the pin rearward of the back panel.

9. The article of furniture as defined by claim 8, further comprising a cleat attached horizontally to a wall immediately adjacent and rearward of said furniture, said cleat having a top surface with first portion thereof closer to the front and top faces of the frame than a second portion thereof, the bottom surface of the rail resting upon the top surface of the cleat, and the endcap and portion of the pin rearward of the back panel disposed in said recess.

10. A kit for constructing an article of furniture, said kit comprising the elements set forth in claim 1 as at least partially disassembled pieces comprising said top, bottom, back, and side panels, said retainer, pin, said endcap, and said rail, and further comprising hardware for attaching said pieces together to produce a piece of furniture.

11. The kit as defined by claim 10, wherein the retainer is pre-attached to and in moveable relationship with the back panel, the retainer having at least one pin extending through the back panel and secured by an endcap to prevent removal of the retainer from the back panel.

12. The kit as defined by claim 11, further comprising a guide pre-attached to a front portion of the back panel at opposing ends of a vertical extent of the guide, the guide comprising at least one guide slot aligned with a corresponding back panel slot.

13. The kit as defined by claim 11, further comprising a false back, and wherein said false back is pre-attached to the back panel effective to secure the retainer and guide therein.

14. The kit as defined by claim 10, further comprising a false back, and wherein said false back is pre-attached to the back panel effective to secure the retainer therein.

15. The kit as defined by claim 14, further comprising as a disassembled piece a cleat, and further comprising hardware for attaching said cleat to a wall.

16. The kit as defined by claim 10, further comprising as a disassembled piece a cleat, and further comprising hardware for attaching said cleat to a wall.

17. A kit for retrofitting a self-supporting piece of furniture to secure the same to a wall, comprising as separate pieces:

a rail;

a cleat; and a spacer;

wherein the rail, the cleat, and the spacer, each has a first extent defining a horizontal extent and being longer than both a second extent defining a vertical extent and a third extent defining a depth, and wherein the rail and the cleat each has a side designed to cooperatively engage an opposing side on the other when the rail is disposed vertically on top of the cleat, and wherein the combined third extents of the rail and cleat, when so cooperatively engaged, is the same as that of the third extent of the spacer;

whereby when said rail is attached to said furniture, and said cleat and spacer are attached to said wall, said furniture is hung from said cleat.

18. The kit as defined by claim 17, further comprising separate pieces of hardware for attaching the rail and the spacer to different places on the back of a piece of furniture, and for attaching the cleat to a wall.

19. The kit as defined by claim 18, further comprising printed instructions for attaching the rail and the spacer different locations on a piece of furniture and for attaching the cleat to a wall.

20. The kit as defined by claim 17, further comprising printed instructions for attaching the rail and the spacer at different locations on a piece of furniture and for attaching the cleat to a wall.

* * * * *